United States Patent [19]

Adam

[11] 4,170,817

[45] Oct. 16, 1979

[54] METHOD AND MEANS OF PACKAGING NUCLEAR FUEL RODS FOR HANDLING

[75] Inventor: Milton F. Adam, Idaho Falls, Id.

[73] Assignee: The United States of America as represented by the United States Department of Energy, Washington, D.C.

[21] Appl. No.: 902,184

[22] Filed: May 2, 1978

[51] Int. Cl.[2] ..... G21F 9/28

[52] U.S. Cl. ..... 29/450; 29/728; 252/301.1 W; 422/159; 29/235

[58] Field of Search ..... 252/301.1 W; 29/450, 29/453, 235, 291, 728; 422/159

[56] References Cited

U.S. PATENT DOCUMENTS

| | | | |
|---|---|---|---|
| 3,733,677 | 5/1973 | Loeffler | 29/728 |
| 3,795,275 | 3/1974 | Bohn | 29/728 |
| 4,124,445 | 11/1978 | Mollon | 252/301.1 W |

*Primary Examiner*—Benjamin R. Padgett
*Assistant Examiner*—Deborah L. Kyle
*Attorney, Agent, or Firm*—Dean E. Carlson; Frank H. Jackson; Donald P. Reynolds

[57] ABSTRACT

Nuclear fuel rods, especially spent nuclear fuel rods that may show physical distortion, are encased within a metallic enclosing structure by forming a tube about the fuel rod. The tube has previously been rolled to form an overlapping tubular structure and then unrolled and coiled about an axis perpendicular to the tube. The fuel rod is inserted into the tube as the rolled tube is removed from a coiled strip and allowed to reassume its tubular shape about the fuel rod. Rollers support the coiled strip in an open position as the coiled strip is uncoiled and allowed to roll about the fuel rod.

4 Claims, 5 Drawing Figures

METHOD AND MEANS OF PACKAGING NUCLEAR FUEL RODS FOR HANDLING

CONTRACTUAL ORIGIN OF THE INVENTION

The invention described herein was made in the course of or under, a contract with the UNITED STATES ENERGY RESEARCH AND DEVELOPMENT ADMINISTRATION.

BACKGROUND OF THE INVENTION

This invention relates to a method and means of encasing long slender objects such as nuclear fuel rods for shipment and handling.

Nuclear fuel rods, especially those that have been removed from a nuclear reactor, present a technical challenge when it is desired to remove them from one location to another. The fuel rods are slender and spent fuel rods are made brittle by exposure to radiation. Spent fuel rods emit radiation and may be heated enough by the presence of radioactive fission products to need cooling for shipment. They must be separated from each other to permit the circulation of coolant and to protect them from damage by rubbing against each other or the shipping container.

Present practice for shipping spent fuel rods involves first inserting the spent rods into metal tubing and supporting the tubing in a geometrically spaced arrangement in a shipping cask. The geometrical arrangement facilitates the circulation of a coolant about the rods and the tubing provides structural support for rods that are typically slender enough to be whippy and are in addition embrittled from radiation when they have been in a nuclear reactor. Spent rods can only be thus inserted in tubing in a hot cell which protects operators from dangerous radiation. When a spent rod is warped or bowed, it becomes difficult to insert the rod into a metal tube and it is necessary in any event to use a tube that is enough oversize to permit the insertion of a rod that exhibits typical distortion. This is especially true if the rod must be inserted by remote means in a hot cell. In addition, the tendency apparent in present reactor development is that fuel rods seem to become increasingly slender and increasingly long. For example, fuel rods for the EBR-II reactor, located at the west facility of the Argonne National Laboratory at the Idaho National Engineering Laboratory, range in diameter from 3/16 inch to ¼ inch and are of the order of 5 feet long. Fuel rods for the Fast Flux Test Facility (FFTF) are 94 inches in length with diameters of the same order as those of the EBR-II. Such rods need protection on shipment whether spent or not and the method of protection must be feasible for use with spent rods that exhibit some physical distortion.

It is an object of the present invention to provide a better method and means of encasing nuclear fuel rods for shipment.

It is a further object of the present invention to provide a better method and means of encasing nuclear fuel rods in tubular containers.

It is a further object of the present invention to provide a better method and means of encasing distorted spent nuclear fuel rods for insertion into a shipping cask.

Other objects will become apparent in the course of a detailed description of the invention.

SUMMARY OF THE INVENTION

A long slender object such as a nuclear fuel rod is encased in a metal tube for shipping by rolling a preformed springy metal strip into the shape of a tube on the outside of the long slender object. The log slender object is recovered after shipping by unrolling and recoiling the strip. Rollers support the springy metal strip that is coiled into a cylinder and uncoiled to roll the strip onto the slender object.

DETAILED DESCRIPTION OF THE INVENTION

Figure 1:
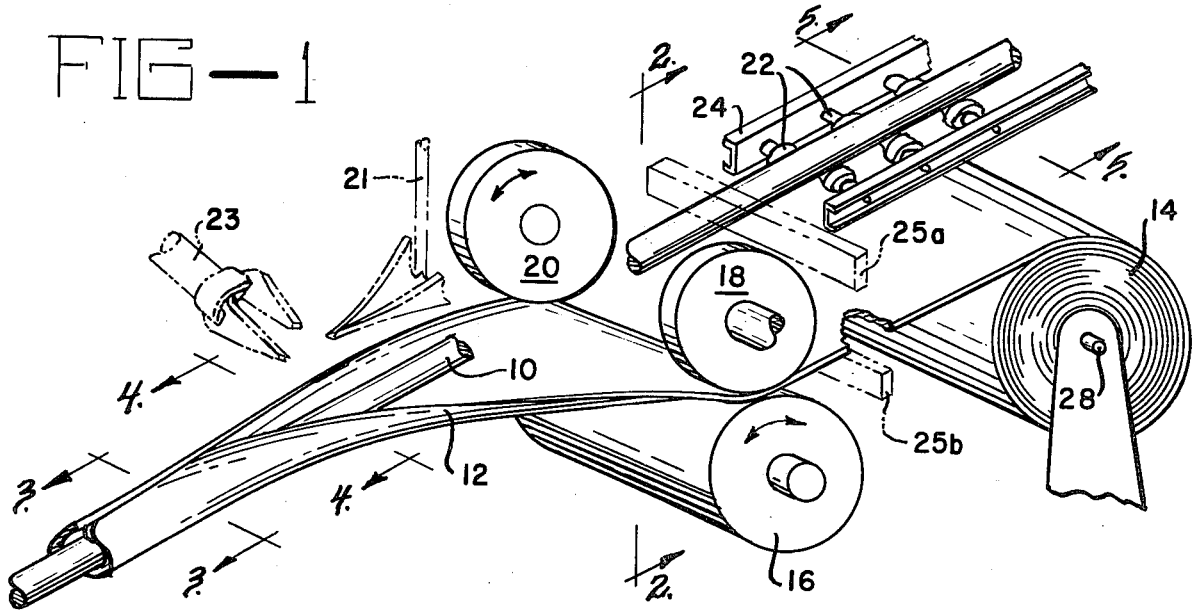
FIG. 1 is a perspective view of an apparatus for the practice of the present invention.

FIG. 1 is a perspective view of an apparatus for the practice of the present invention. In FIG. 1, a fuel rod 10 that is initially not encased is encased in tube 12 by moving the fuel rod 10 into conjunction with a coiled strip 14 that has previously been rolled into the shape of a cylinder, then unrolled, flattened and coiled without exceeding its elastic limit. Coiled strip 14 is passed over a wide roller 16 and it is held in contact against its spring tension on wide roller 16 by narrow rollers 18 and 20. Alternatively, coiled strip 14 may be unrolled directly onto a fuel rod 10. Fuel rod 10 is supported before it is encased by the shaped rollers 22 of roller conveyor 24. The fuel rod 10 is advanced between narrow rollers 18 and 20 and is placed in contact with the coiled strip 14 that has been passed over wide roller 16. Fuel rod 10 is then advanced at the same rate of speed that coiled strip 14 is uncoiled. As the holding force of narrow rollers 18 and 20 is no longer applied to the coiled strip 14, there is nothing to hold coiled strip 14 flat and the spring tension associated with its permanent set causes coiled strip 14 to roll about and enclose fuel rod 10. Drive control 26 is connected at least to wide roller 16 and narrow rollers 18 and 20 to feed coiled strip 14 as described. Drive control 26 may also be coupled to uncoil coiled strip 14 from shaft 28 and it may be coupled to shaped rollers 22 to advance a fuel rod 10 for encasing. A roller conveyor similar to roller conveyor 24 may be placed to support an encased fuel rod. This supporting conveyor is not shown in the interest of clarity. The apparatus may be operated in reverse to remove a fuel rod 10 from a tube 12 and rewind coiled strip 14 for reuse. It may be desirable to use a tube spreader 21 to start a process of opening a tube 12, and also to use one or more grippers 23 to flatten the coiled strip 14 for insertion between narrow rollers 18 and 20 and wide roller 16. If it is desired to use coiled stock in lengths longer than the length of a fuel rod 10, it may be desirable to use means such as shears **25*a* and 25*b*** to cut a length of stock commensurate with the length of a fuel rod.

Figure 2:
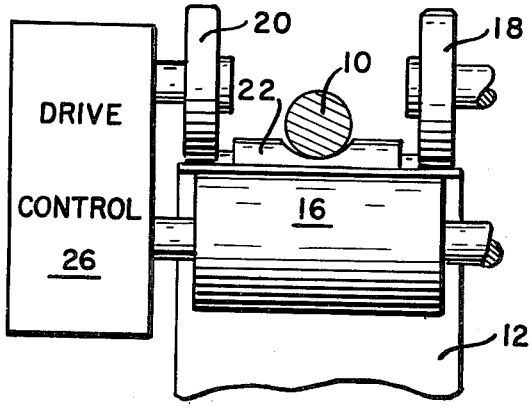
FIG. 2 is a partial sectional end view of the apparatus of FIG. 1, taken along section lines 2—2 of FIG. 1.
Figure 4:
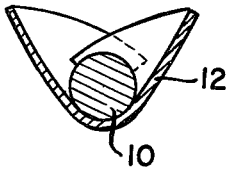
FIG. 4 is a sectional end view of the tubing being encased in FIG. 1, taken along section lines 4—4.
Figure 5:
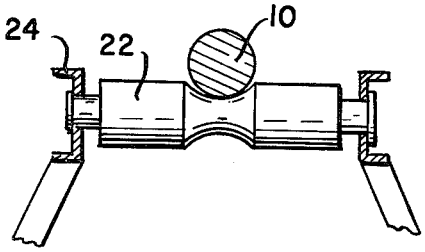
FIG. 5 is a sectional view of a fuel rod and its support before encasing, taken along section lines 5—5 of FIG. 1.
Figure 3:
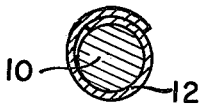
FIG. 3 is a sectional end view of the encased tubing of FIG. 1, taken along section lines 3—3.

Further details are evident from inspection of the various sectional views of FIGS. 2–5. FIG. 2 is a partial sectional end view of the apparatus of FIG. 1 taken along section lines 2—2 of FIG. 1. FIG. 3 is a sectional end view of the encased fuel rod of FIG. 1 taken along section lines 3—3. FIG. 4 is a sectional end view of the fuel rod as it is being encased in FIG. 1 taken along section lines 4—4. FIG. 5 is a sectional view of a fuel rod before it is encased and the support structure that places it for encasing taken along section lines 5—5 of FIG. 1. In FIG. 2, fuel rod 10 is seen to be supported by shaped roller 22 while fuel rod 10 is advanced to be placed on top of the flattened coiled strip 14. Wide roller 16 is driven by drive control 26 to advance coiled strip 14 past wide roller 16 while narrow rollers 18 and 20 hold down coiled strip 14 at its outer edges. FIG. 3 shows the desired end result in cross section with fuel rod 10 encased within tube 12 and held there by the spring tension of tube 12. It follows by inspection of FIG. 3 that the width of coiled strip 14 must be chosen somewhat in excess of the circumference of fuel rod 10. The encasing process is shown as it happens in FIG. 4 in which fuel rod 10 is partly but not completely encased by tube 12. Spring tension is bending coiled strip 14 about fuel rod 10 in FIG. 4, but the effects of narrow rollers 18 and 20 still persist at the location shown so that tube 12 has not yet been able to wrap completely about fuel rod 10. FIG. 5, the sectional view of fuel rod 10 before it is encased, illustrates the fact that the fuel rod is well adapted for easy remote handling. The roller conveyor 24 need only be operated to advance the fuel rod 10 into contact with coiled strip 14 of FIG. 1 as coiled strip 14 is rolled past wide roller 16. An inspection of FIGS. 3, 4, and 5 shows that with an appropriate shape to the rollers 22 of FIG. 5 it is possible to accommodate a significant amount of warping or blistering or other damage and still advance fuel rod 10 in roller conveyor 24 for wrapping. FIGS. 3 and 4 show that it is possible to wrap a distorted fuel rod since the effect of distortions will only be to cause a slight reduction in the overlap of tube 12.

The apparatus of the present invention has been shown as adapted to continuous encasement. Since fuel rods such as fuel rod 10 are discrete, it will be desirable to have some means of interrupting coiled strip 14 to complete the encasement of individual rods. This may be done either by selecting lengths of coiled strip 14 that are appropriate to the lengths of fuel rods being encased or it may be done by adding cutting means such as shears 25*a* and 25*b* to cut sections of coiled strip 14 to an appropriate length. In either case, it is a simple matter to add handling means such as eyelets, hooks or the like by drilling, punching or stamping appropriate shapes in the material of coiled strip 14 that will project beyond an end of a fuel rod 10 after fuel rod 10 is encased.

It should be evident by inspection of the figures that any given size of coiled strip 14 is adaptable to a range of diameters of fuel rods 10 and that to practice the invention by encasing fuel rods of different sizes would require only that the width of a coiled strip 14 be sized appropriately for the fuel rods. Use of a narrower coiled strip 14 would require that narrow rollers 18 and 20 be moved closer together, while the use of a wider coiled strip 14 could be handled either by moving the narrow rollers 18 farther apart and using a wider wide roller 16 or over a range of sizes the apparatus could be used as is with a portion of the coiled strip 14 projecting beyond the edges of wide roller 16 and narrow rollers 18 and 20.

The embodiments of the invention in which an exclusive property or privilege is claimed are defined as follows:

1. An apparatus for encasing a slender cylindrical object in a metallic enclosing structure comprising:

(a) a coiled strip of an elastic metallic material that is formed into a overlapping cylindrical tube and then rolled into a coil under elastic stress such that upon release the elastic metallic material will resume a shape of an overlapping cylindrical tube;

(b) means for unrolling the rolled coiled strip to release the coil and permit the elastic metallic material to resume the shape of the overlapping cylindrical tube; and (c) means for moving the slender cylindrical object into engagement with the releasing coil such that the elastic metallic material resumes substantially the shape of the overlapping cylindrical tube while forming around an enclosing the slender cylindrical object, whereby the slender cylindrical object is encased in the metallic enclosing structure.

2. The apparatus of claim 1 comprising in addition means for removing the overlapping cylindrical tube from the long slender object.

3. The apparatus of claim 1 comprising in addition means for cutting the unrolled elastic metallic material to a length commensurate with the long slender object.

4. A method of encasing a long slender object for shipping comprising the steps of:

(a) rolling a strip of elastic material to form an overlapping structure that is substantially a cylinder having an axis parallel to a long dimension of the strip, the strip further caused to have a permanent set in the form of the overlapping structure;

(b) unrolling the strip to open the overlapping stucture;

(c) coiling the strip into a spiral about an axis that is perpendicular to the axis of the overlapping structure; and (d) uncoiling the strip against a long slender object to allow the permanent set to form the overlapping structure about the long slender object, whereby the long slender object is encased within the overlapping structure.

* * * * *